US010222049B2

(12) United States Patent
Porciatti

(10) Patent No.: US 10,222,049 B2
(45) Date of Patent: Mar. 5, 2019

(54) ANGLED LIGHTING INTEGRATED INTO A CEILING T-BAR

(71) Applicant: JLC-Tech IP, LLC, Weston, FL (US)

(72) Inventor: Silvio Porciatti, Pembroke, MA (US)

(73) Assignee: JLC-TECH IP, LLC, Weston, FL (US)

( * ) Notice: Subject to any disclaimer, the term of this patent is extended or adjusted under 35 U.S.C. 154(b) by 0 days.

(21) Appl. No.: 15/973,838

(22) Filed: May 8, 2018

(65) Prior Publication Data

US 2018/0259173 A1 Sep. 13, 2018

Related U.S. Application Data

(63) Continuation-in-part of application No. 15/863,276, filed on Jan. 5, 2018, which is a continuation of (Continued)

(51) Int. Cl.

| | |
|---|---|
| ***F21V 29/76*** | (2015.01) |
| ***F21V 23/02*** | (2006.01) |
| ***F21S 4/28*** | (2016.01) |
| ***F21V 33/00*** | (2006.01) |
| ***E04B 9/00*** | (2006.01) |
| ***E04B 9/06*** | (2006.01) |
| ***F24F 3/056*** | (2006.01) |

(Continued)

(52) U.S. Cl.

CPC ..... *F21V 29/767* (2015.01); *E04B 9/006* (2013.01); *E04B 9/067* (2013.01); *F21S 4/28* (2016.01); *F21V 23/023* (2013.01); *F21V 23/026* (2013.01); *F21V 29/763* (2015.01); *F21V 33/006* (2013.01); *F24F 3/056* (2013.01); *F21S 2/005* (2013.01); *F21S 8/02* (2013.01); *F21S 8/026* (2013.01); *F21S 8/04* (2013.01); *F21S 8/043* (2013.01); *F21V 29/503* (2015.01); *F21V 29/74* (2015.01); *F21V 33/0088* (2013.01); *F21Y 2105/10* (2016.08); *F21Y 2115/10* (2016.08)

(58) Field of Classification Search

CPC .... F21V 29/767; F21V 29/763; F21V 23/026; F21V 33/006; F21S 4/28

See application file for complete search history.

(56) References Cited

U.S. PATENT DOCUMENTS

| | | | |
|---|---|---|---|
| 1,913,377 | A | 6/1933 | Dorey |
| D162,843 | S | 4/1951 | Klein |

(Continued)

FOREIGN PATENT DOCUMENTS

| | | | |
|---|---|---|---|
| KR | 20-0447421 | Y1 | 1/2010 |

*Primary Examiner* — Joseph L Williams

(74) *Attorney, Agent, or Firm* — Heisler & Associate

(57) ABSTRACT

A housing is located at least partially beneath a rest shelf of a T-bar or other support for ceiling tiles. A spine extends up from the rest shelf. The housing includes an opening with a centerline which extends at least partially laterally. A light source such as an LED within a recess of the housing shines out of the opening along the centerline in an at least partially lateral direction. A diffuser is preferably provided spanning this opening. The housing preferably includes a front wall opposite a rear wall, with the rear wall larger than the front wall and with the opening in the housing extending between lower portions of the rear wall and lower portions of the front wall. Heat transfer fins on an upper surface of the rest shelf and upper end of the spine are preferably provided to assist in heat dissipation.

27 Claims, 5 Drawing Sheets

Related U.S. Application Data application No. 13/634,219, filed as application No. PCT/US2011/000455 on Mar. 10, 2011, now Pat. No. 9,879,850, which is a continuation of application No. 12/661,252, filed on Mar. 11, 2010, now Pat. No. 8,177,385.

(60) Provisional application No. 62/502,948, filed on May 8, 2017.

(51) Int. Cl.

| | |
|---|---|
| *F21S 8/02* | (2006.01) |
| *F21V 29/503* | (2015.01) |
| *F21S 2/00* | (2016.01) |
| *F21S 8/04* | (2006.01) |
| *F21Y 105/10* | (2016.01) |
| *F21Y 115/10* | (2016.01) |
| *F21V 29/74* | (2015.01) |

(56) References Cited

U.S. PATENT DOCUMENTS

| | | | |
|---|---|---|---|
| 4,126,971 | A | 11/1978 | Macuga |
| 4,230,900 | A | 10/1980 | Speet |
| 4,794,745 | A | 1/1989 | Platt |
| 4,972,339 | A | 11/1990 | Gabrius |
| D315,832 | S | 4/1991 | Rocheleau |
| D338,449 | S | 8/1993 | Sahyoun |
| 5,313,759 | A | 5/1994 | Chase, III |
| 5,454,756 | A | 10/1995 | Ludwig |
| 5,613,759 | A | 3/1997 | Ludwig |
| 5,687,527 | A | 11/1997 | Bikard |
| D394,595 | S | 5/1998 | Walsh |
| 5,848,833 | A | 12/1998 | Margulies |
| 6,220,721 | B1 | 4/2001 | Chan |
| D445,211 | S | 7/2001 | Baker |
| D488,243 | S | 4/2004 | Babka |
| 7,383,670 | B1 | 6/2008 | Meyers |
| D581,376 | S | 11/2008 | Shaner |
| 7,621,497 | B2 | 11/2009 | Wallace |
| D606,501 | S | 12/2009 | Plonski |
| D616,568 | S | 5/2010 | Desrosiers |
| D627,095 | S | 11/2010 | Miyairi |
| D649,684 | S | 11/2011 | Trzesniowski |
| D649,685 | S | 11/2011 | Trzesniowski |
| D649,686 | S | 11/2011 | Trzesniowski |
| D649,687 | S | 11/2011 | Trzesniowski |
| D649,688 | S | 11/2011 | Trzesniowski |
| D649,693 | S | 11/2011 | Trzesniowski |
| 8,061,865 | B2 | 11/2011 | Piepgras |
| D651,739 | S | 1/2012 | Trzesniowski |
| D652,568 | S | 1/2012 | Trzesniowski |
| D652,569 | S | 1/2012 | Trzesniowski |
| D652,985 | S | 1/2012 | Trzesniowski |
| D652,986 | S | 1/2012 | Trzesniowski |
| 8,177,385 | B2 | 5/2012 | Porciatti |
| D662,255 | S | 6/2012 | Klu |
| D662,256 | S | 6/2012 | Klu |
| D662,653 | S | 6/2012 | Hochman |
| 8,459,824 | B1 | 6/2013 | Esmailzadeh |
| D782,104 | S | 3/2017 | Klus |
| D782,106 | S | 3/2017 | Porciatti |
| 9,746,142 | B2 | 8/2017 | Narendran |
| 9,879,850 | B2 | 1/2018 | Porciatti |
| 9,883,267 | B2 | 1/2018 | Porciatti |
| D818,186 | S | 5/2018 | Trzesniowski |
| D818,187 | S | 5/2018 | Trzesniowski |
| D818,188 | S | 5/2018 | Trzesniowski |
| 2003/0021116 | A1 | 1/2003 | Miller |
| 2003/0081419 | A1 | 5/2003 | Jacob |
| 2004/0095771 | A1 | 5/2004 | McDonald |
| 2004/0213003 | A1 | 10/2004 | Lauderdale |
| 2005/0152132 | A1 | 7/2005 | Bernhart |
| 2006/0262521 | A1 | 11/2006 | Piepgras |
| 2008/0266843 | A1 | 10/2008 | Villard |
| 2009/0147504 | A1 | 6/2009 | Teeters |
| 2009/0316391 | A1 | 12/2009 | Huang |
| 2011/0058376 | A1 | 3/2011 | Lin |
| 2011/0075416 | A1 | 3/2011 | Chou |
| 2011/0080746 | A1 | 4/2011 | Patti |
| 2011/0103043 | A1 | 5/2011 | Ago |
| 2011/0222270 | A1 | 9/2011 | Porciatti |
| 2013/0039042 | A1 | 2/2013 | Kotovsky |
| 2013/0323950 | A1 | 12/2013 | Gingrich, III |
| 2014/0268755 | A1 | 9/2014 | Kotovsky |
| 2016/0076746 | A1 | 3/2016 | Porciatti |
| 2017/0356603 | A1 | 12/2017 | Narendran |
| 2018/0128475 | A1 | 5/2018 | Porciatti |

ANGLED LIGHTING INTEGRATED INTO A CEILING T-BAR

CROSS-REFERENCE TO RELATED APPLICATIONS

This application claims benefit under Title 35, United States Code § 119(e) of U.S. Provisional Application No. 62/502,948 filed on May 8, 2017. Each of U.S. Pat. Nos. 8,177,385 and 9,879,850 and U.S. patent application Ser. No. 15/863,276 are incorporated herein by reference in their entirety. This application is a continuation-in-part of U.S. patent application Ser. No. 15/863,276 filed on Jan. 5, 2018, which is a continuation of U.S. patent application Ser. No. 13/634,219 filed on Sep. 11, 2012 and issued as U.S. Pat. No. 9,879,850 on Jan. 30, 2018, which is a continuation and claims benefit of the earlier filing dates associated with International Application No. PCT/US2011/000455 filed on Mar. 10, 2011, which designates the United States and other countries; and is a continuation of U.S. patent application Ser. No. 12/661,252 filed on Mar. 11, 2010 and issued as U.S. Pat. No. 8,177,385 on May 15, 2012, which was claimed for priority in the above-identified international application.

FIELD OF THE INVENTION

The following invention relates to T-bars and other structures for supporting ceiling tiles within a ceiling of a residential building or other interior space. More particularly, this invention relates to ceiling tile T-bar supports and other supports which include lighting therein, and especially lighting which is angled so that light is projected at least partially laterally.

BACKGROUND OF THE INVENTION

Placing lights within T-bars which are also used to suspend ceiling tiles for a "dropped ceiling" is a known lighting option. Such lighting utilizes LED lighting technology to have a relatively bright but low power light provided from a relatively small space within a lower portion of the T-bar which is exposed below ceiling tiles supported by the T-bar.

Such known prior art LED lights within T-bars have, to this point, been limited to general lighting shining downward from the T-bar. In certain instances, it is desirable to focus the light in a direction other than generally downward. For instance, it is sometimes desirable to have light focus upon a wall or a portion of a wall at a perimeter of an indoor space beneath a "dropped ceiling," such as where a sign, decorative artwork, or some other point of emphasis is located and for which focused lighting is desired. Known prior art T-bar lighting is not able to focus light upon an adjacent wall, but at best, can be placed close enough to the wall that it will provide some light onto the wall.

Spotlights are known in the prior art which can be mounted to ceilings or dangling from ceilings, or supported from the ground and can spotlight particular points of emphasis. However, such spotlights in many instances take up more space within a room then is desired. Also, while such spotlights can be decoratively designed so that their presence within the space can be part of the decorative appearance thereof, it is sometimes desirable for the lighting to be largely hidden, so that the lighting does not become part of the decor within the space, rather the focus is placed substantially entirely upon the location or object of interest at which the light is focused, rather than the lights themselves.

Accordingly, a need exists for lighting which is largely concealed, but which can shine upon and provide emphasis for a point of interest within a lighted space. Beneficially, such lighting would be integrated into a ceiling in such a way that the lighting would be concealed (at least partially) and thus be highly unobtrusive to the visual appearance of the space. Also, it is beneficial if the lighting does not add significantly to heat within an air-conditioned space below ceiling tiles of a dropped ceiling, but rather keeps the majority of heat generated by the lighting out of the air-conditioned space, while still being able to provide focused lighting upon a particular point of interest in an unobtrusive fashion.

SUMMARY OF THE INVENTION

With this invention, a T-bar is provided which includes a lighting source within a housing which is asymmetrical and angled so that light emanating therefrom is not straight downward, but rather shines at an angle to vertical and horizontal, and is thus "lateral" in orientation. In this way, light can be shown upon a wall or onto some other space other than space directly downward below the T-bar. Positioning of light beneath the ceiling can thus be somewhat independent of the location of the T-bars within the ceiling, rather than requiring ceiling modification to place light where desired. Also, an additional design/lighting tool is provided for interior architectural design, in that light extending at an angle away from vertically downward can be selected such that shadowing and other attributes of the lighting can be more fully controlled, especially at a point of particular interest, such as a sign, wall mounted art, doorways in walls, or angled lighting to produce a unique and desirable affect at a point of interest anywhere in the space beneath the dropped ceiling.

Generally, the angled lighting T-bar, in one form, has a constant cross-sectional shape (typically formed by a method such as extrusion) extending between ends which can include attachment structures to attach and to be connected to adjacent T-bars and from above. The contour of the T-bar includes a spine with a heat sink optimally at an upper end thereof, in one form of the invention. A rest shelf below the spine has front and rear portions upon which ceiling tile edges can rest.

A lower lighting source housing in the contour includes an upper portion provided by the rest shelf. With this embodiment, the lighting source housing includes a front wall and a rear wall which has differing downwardly extending lengths, extending down from opposite front and rear ends of the rest shelf. The front wall is shorter than the rear wall, so that lighting extends forwardly somewhat and as it also extends somewhat downwardly out of a recess where the lighting source is provided. The lighting source is typically in the form of a series of high-intensity LEDs along a longitudinal support structure (typically a printed circuit board ("PCB")), which supplies power/circuitry and physically supports the LEDs thereon. Typically, a light diffuser is provided outboard of the lighting source and at an opening into a recess in the housing, which helps to contain the lighting source within the interior recess of the housing, and also can be configured to diffuse the light if desired.

In one embodiment, the diffuser extends from a lowermost end of the front wall to (or near) a lower most end of the rear wall. An angle of this diffuser away from a horizontal plane, and a centerline of light shining from the lighting source can be selected to match a desired angle in which light will be angled away from vertically downward. In the embodiment shown, an angle of approximately 50° away from horizontal is provided for the light, so that the lighting module face and diffuser are both preferably angled about 40° away from a horizontal orientation with light shining along the centerline perpendicular to the plane of the diffuser, in this exemplary form.

Angled lighting T-bars can be provided with lighting modules having various different angles in which a plane of the diffuser and a plane in which the LEDs of the lighting element point, which are angled relative to vertical and horizontal. While the lighting module is typically angled along with the diffuser at the desired angle, it is conceivable that the lighting module could always be oriented in a first manner, along with LEDs associated therewith, such as vertically downward, and the diffuser could be distinctly oriented and configured to refract or reflect the light (or a combination thereof) to cause the light to emanate from the diffuser at a desired angle with some amount of designed light redirection from the lighting element through the diffuser and out of the lower lighting module of the angled lighting T-bar. Similarly, some form of fiber optic light pathways (or prisms, lenses, mirrors or other optics) could be provided to cause the light to extend in a desired direction as the light leaves the LED and arrives at the diffuser (or to change direction within the diffuser itself). The lighting source orientation could also be made to be adjustable, at least somewhat, to allow for some customization of light direction by a user.

Heat transfer fins associated with a heat sink, such as at an upper end of the spine and also optionally associated with the rest shelf, can be provided to assist in drawing heat away from the lighting source in the recess of the housing and up to a waste heat space above ceiling tiles of the dropped ceiling. In this way, air-conditioned space below the tiles is not burdened with the heat load of the LEDs shining into this air-conditioned space. It is generally desirable that the T-bar have an efficient and simple cross-sectional form to minimize unnecessary structure (and/or fans to promote heat transfer), while still structurally being configured adequate to support ceiling tiles within the drop ceiling, and also to efficiently drive heat (primarily) by conduction from the recess where the lighting source is located, up to either the upper surface of the rest shelf and/or up to the heat sink at the upper end of the spine.

To accomplish transfer of heat to air above the ceiling tiles, the contour of the angled lighting T-bar is formed of aluminum or other material with a high coefficient of heat transfer and a low thermal resistance. Also, the upper surface of the rest shelf can be provided with a plurality of fins, such as extending substantially upwardly, with an outermost fin most distant from the spine slightly taller, so that air circulation can access space between each of the fins on the upper surface of the rest shelf.

The heat sink at the upper end of the spine includes a plurality of fins extending horizontally perpendicularly away from the spine. The heat sink, spine, rest shelf, and lower lighting module are, in one embodiment, all provided as a unitary mass which is extruded through a die having a contour which causes the T-bar to have a desired final cross-sectional shape and all formed from a material which promotes conduction heat transfer therethrough.

Lowermost ends of the front wall and rear wall in one embodiment include slots which are sized to engage edges of a diffuser so that an appropriately sized diffuser can slide or snap into these slots for containment of the diffuser therein at a desired angle. This angle could be adjusted to other fixed angles, or could be adjustable between different angles, such as by providing multiple slots/grooves at different positions and selecting a slot/groove having a desired angle for the diffuser, or angling the diffuser out to attach to the grooves/slots, but for a set of the diffuser to be selectable to reside in a plane that diffuses between the diffusers in the set, relative to the plane between the grooves/slots or other attachment structures for the diffuser.

Holes can be provided through the rest shelves to allow for wiring to access the recess area within the housing and supply power to a lighting source contained within the recess and above the diffuser. This wiring can then pass up to a source of electric power for the angled lighting T-bar. Typically, this power source is a DC power supply output which typically includes a transformer so that it can be plugged into or otherwise wired into an AC power supply and still function effectively and optimally with the LEDs. However, other forms of lighting could alternatively be provided.

As an alternative to the lighting module being oriented with light shining downward, and relying on the diffuser to angle the light, the lighting source and/or PCB or other structural support can be itself angled so that light passes out of the lighting element and straight through the diffuser, and then have a desired lateral angle for a centerline of light associated therewith, shining from the lighting source.

OBJECTS OF THE INVENTION

Accordingly, one object of various embodiments of the present invention is to provide both support for ceiling tiles and lighting within a single multipurpose ceiling support structure, and with the lighting projecting at least partially laterally therefrom.

Another object of various embodiments of the present invention is to provide directional lighting within a T-bar of a ceiling within an interior space.

Another object of various embodiments of the present invention is to provide illumination for walls and other elements spaced laterally from a light source.

Another object of various embodiments of the present invention is to provide laterally projecting lighting mounted upon a ceiling, which extends down from the ceiling a minimal amount.

Another object of various embodiments of the present invention is to provide lighting extending laterally from a ceiling, while avoiding a need for separate lighting elements filling spaces between T-bars in a dropped ceiling.

Another object of various embodiments of the present invention is to provide lighting from a light source which is mostly hidden from view.

Another object of various embodiments of the present invention is to provide lighting within an interior space with heat generated by the lighting largely transmitted outside of the space.

Another object of various embodiments of the present invention is to provide a method for projecting light laterally from a ceiling, from a light source which is integrated into a ceiling tile supporting T-bar or other support structure.

Other further objects of various embodiments of the present invention will become apparent from a careful reading of the included drawing figures, the claims and detailed description of the invention.

DESCRIPTION OF THE PREFERRED EMBODIMENT

Figures 1, 2, 3:
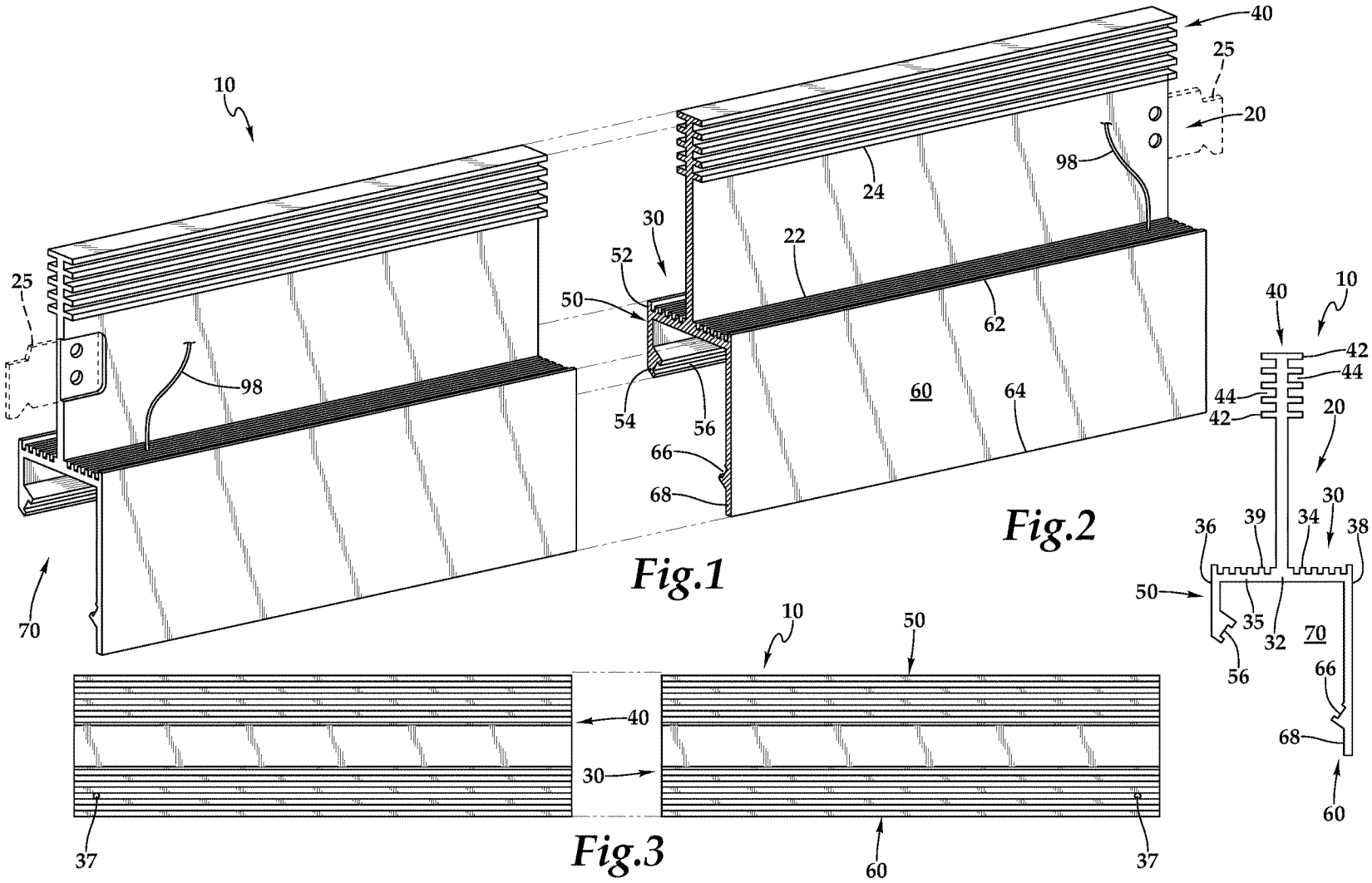
FIG. 1 is a perspective view of the angled lighting T-bar of this invention, according to an example embodiment, and with end connector structures shown in broken lines, and with a central portion of the elongate structure removed to allow for enlargement of details of the contour of the invention in this embodiment.
FIG. 2 is an end view of that which is shown in FIG. 1, revealing a cross-sectional contour of the invention according to this embodiment.
FIG. 3 is a top plan view of that which is shown in FIG. 1.
Figure 4:
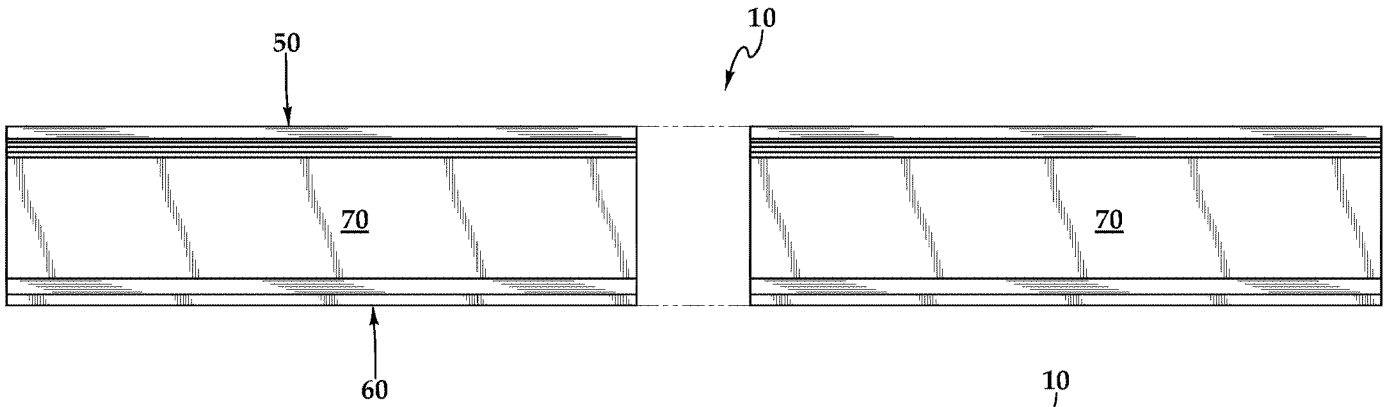
FIG. 4 is a bottom plan view of that which is shown in FIG. 1.

Referring to the drawings, wherein like reference numerals represent like parts throughout the various drawing figures, reference numeral 10 is directed to an angled lighting T-bar (FIGS. 1, 2, 5, 10 and 11) which provides the dual function of holding up ceiling tiles C within a dropped ceiling of an interior space, and also acting as a support for a light source 90 so that light L can shine from the T-bar 10 in a manner angled away from vertical and horizontal, such as to shine light upon a wall W and a sign S, picture P, door D or other item on the wall W, or to otherwise beneficially direct light in a manner other than generally downward from the T-bar 10.

In essence, and with particular reference to FIGS. 1, 2, 5 and 9-11, basic details of the T-bar 10 are described, according to an exemplary embodiment. The T-bar 10 includes a spine 20 extending up from a rest shelf 30, with the rest shelf 30 supporting edges of ceiling tiles C thereon, and with the spine 20 supporting the T-bar 10 from above or from adjacent to T-bars T. A heat sink 40 is preferably provided on an upper end 24 of the spine 20. A housing for a light source 90 extends down from the rest shelf 30, and includes a front wall 50 (most preferably) and a rear wall 60, which are typically parallel and opposite each other, and define a recess 70 between the walls 50, 60 and beneath the rest shelf 30. An opening into this recess 70 is angled, at least partially by having the front wall 50 be shorter than the rear wall 60. A diffuser 80 can optionally span this opening into the recess 70, for diffusing of light L emanating from the light source 90 contained within the recess 70. Light L thus emanates through the diffuser 80 at an angle a generally following a centerline CL along which the lighting source 90 is facing, and perpendicular to a surface of this diffuser 80. This centerline CL of the light L is angled at an angle $\alpha$ away from horizontal and away from vertical, rather with the light L extending laterally from the recess 70 of the T-bar 10.

Figure 5:
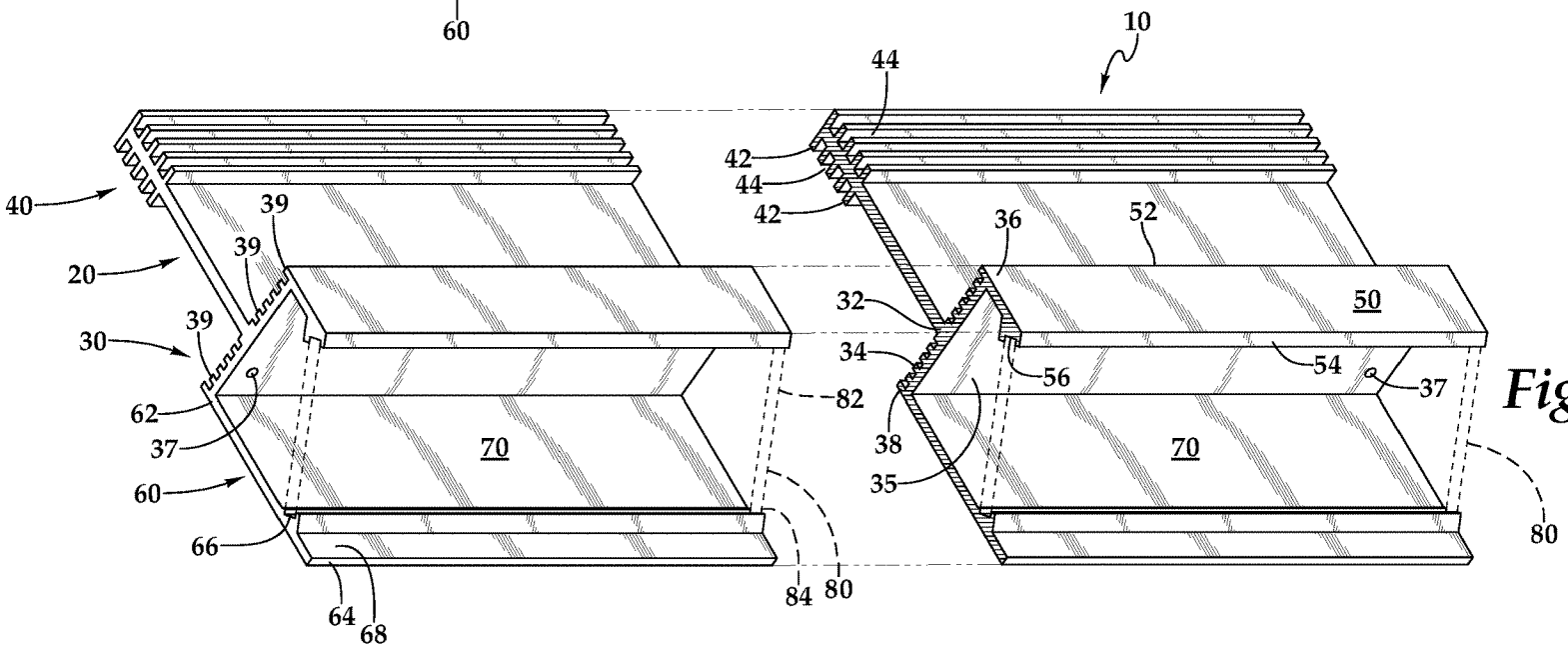
FIG. 5 is a perspective view from below of that which is shown in FIG. 1 and with a diffuser within an opening into the housing of the invention depicted in broken lines.
Figure 6:
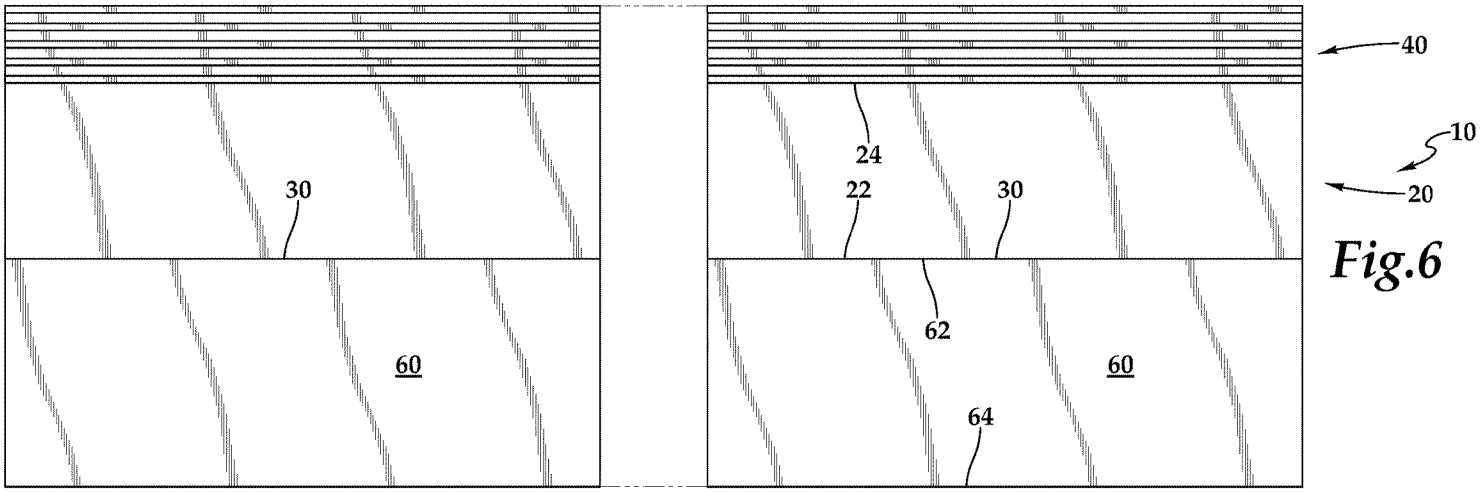
FIG. 6 is a rear elevation view of that which is shown in FIG. 1.
Figure 7:
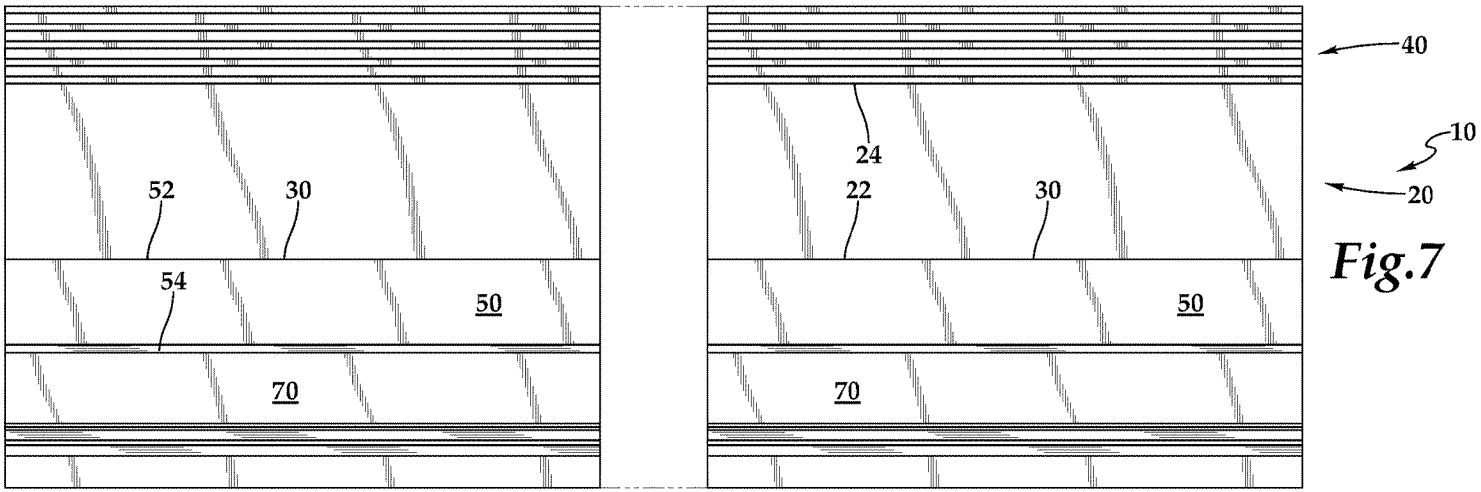
FIG. 7 is a front elevation view of that which is shown in FIG. 1.

More specifically, and with particular reference to FIGS. 1, 2 and 5, as well as to FIGS. 3, 4 and 6-10, particular details of the spine 20, rest shelf 30 and heat sink 40 providing structural portions of the T-bar 10 above the housing for the light source 90, are described, according to this exemplary embodiment. The spine 20 and rest shelf 30 are preferably formed together as an extrusion having a constant cross-sectional form. Most preferably, the spine 20 and rest shelf 30 are formed of aluminum, or other material which can be readily extruded and has appropriate strength characteristics and other characteristics to allow it to effectively support ceiling tiles C within an interior space, typically within a horizontal plane above the interior space.

The front wall 50 and rear wall 60 of the housing are also preferably formed together with the spine 20, rest shelf 30 and housing 40 in a single extrusion having a constant cross-sectional form. As an alternative, the different parts could be manufactured in other ways, such as by bending thin sheets of metal or other material to form the separate portions of the T-bar 10, or by welding, bonding or otherwise joining separate portions of the T-bar 10 together to provide a desired form, of which that form shown in the figures hereof is one example.

The spine 20 is preferably a planar structure which extends within a vertically oriented plane in a typical installation where a ceiling including ceiling tiles C (FIGS. 10 and 11) is to be oriented horizontally. The spine 20 is elongate between ends of the T-bar 10, and of a thin planar form between a lower end 22 opposite an upper and 24. The lower end 22 is joined to the rest shelf 30, such as at a junction 32. The upper end 24 is typically a free end which is suspended from above, such as by having wires anchored above the T-bar 10 and extending down to and connecting to portions of the spine 20. As an alternative, the spine 20 can be supported in position having ends of the T-bar 10 fitted with connectors 25 (FIG. 1) which can attach to a wall W (FIG. 11) or to adjacent T-bars T, such as through slots 28 (FIGS. 8 and 9) formed in such T-bars T.

The spine 20 also includes at least one such slot 24, such as with one vertically oriented slot at a midpoint between ends of the T-bar 10, and preferably with holes 28 on either side of such slots 26. The slots 26 can receive connectors 25 of other T-bars 10, T, so that the angled lighting T-bar 10 of this invention can totally function as a non-lit standard T-bar 10, and additionally includes the lighting source 90 and associated features for angled lighting to emanate from the T-bar 10.

While in this embodiment a single slot 26 is provided at a central point on the spine 20, with holes 28 adjacent thereto, such slots 26 could be located in different numbers and at different locations between ends of the T-bar 10 and passing through the spine 20. The holes 28 provide one location where wires or other suspension elements can attach to the T-bar 10 and then be supported from above, so that such wires passing through the holes 28 act as an anchor for the spine 20 and associated T-bar 10 at a desired height within the interior space bounded by the ceiling tiles C which are supported upon the T-bar 10. The spine 20 can have other forms in other embodiments, with this spine 20 configuration being one configuration which is effective for providing the angled lighting T-bar 10 of this invention.

The rest shelf 30 is a planar structure which is preferably perpendicular to the spine 20 and coupled to the lower end 22 of the spine 20, such as at the junction 32. The rest shelf 30 has an upper surface 34 on the side facing the spine 20 and typically facing upward when the T-bar 10 is supporting a horizontal ceiling. A lower surface 35 opposite the upper surface 34, defines an upper portion of the recess 70 in which the lighting source 90 is located.

The rest shelf 30 includes a front end 36 opposite a rear end 38, with the front end 36 defining an extent of a front portion of the rest shelf 30 and the rear end 38 defining an extent of a rear portion of the rest shelf 30. Wiring holes 37 (FIGS. 3 and 5) preferably pass through the rest shelf 30 at different locations (such as near ends of the T-bar 10), which allow for wiring 98 providing electric power to the lighting source 90 to pass through the rest shelf 30 and into the recess 70 beneath the rest shelf 30. Fins 39 preferably extend upward from the rest shelf 30. The fins 39 aid in heat transfer away from the recess 70 and up to above the rest shelf 30, so that heat is carried by conduction out of the interior space bound by the ceiling. Most preferably, one of the fins 39 (typically the fin 39 most distant from the spine 20) is taller than the other fins 39 to provide a small space for airflow amongst the fins 39. Often such interior space beneath the ceiling is air-conditioned space which is desired to be kept at a lower temperature than surrounding spaces. The lighting source 90 can generate significant heat when it is in operation. Rather than allowing this heat to pass into the interior space and then relying on air conditioning systems to remove that heat from the interior space, with this invention the heat is removed from the interior space initially, so that heat associated with the lighting source 90 does not need to be removed by air-conditioning systems which are conditioning the interior space. While the rest shelf 30 is shown with this particular configuration, other forms for the rest shelf 30 could alternatively be provided according to variations which are within the scope of this invention.

Figure 10:
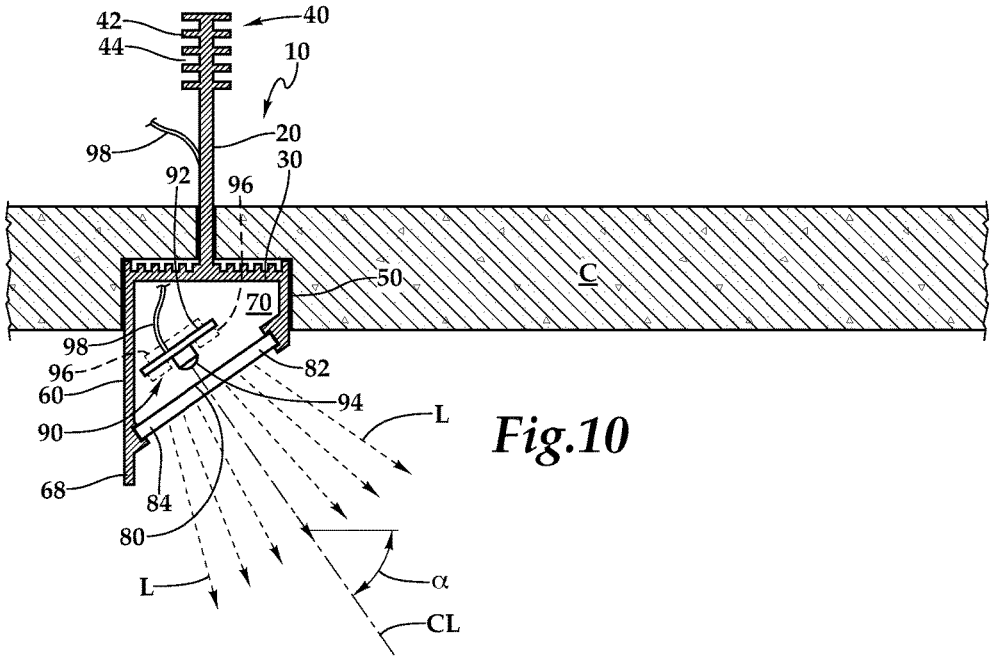
FIG. 10 is a full sectional view of that which is shown in FIGS. 8 and 9, and showed installed in a ceiling above an interior space and with ceiling tiles resting thereon.
Figure 11:
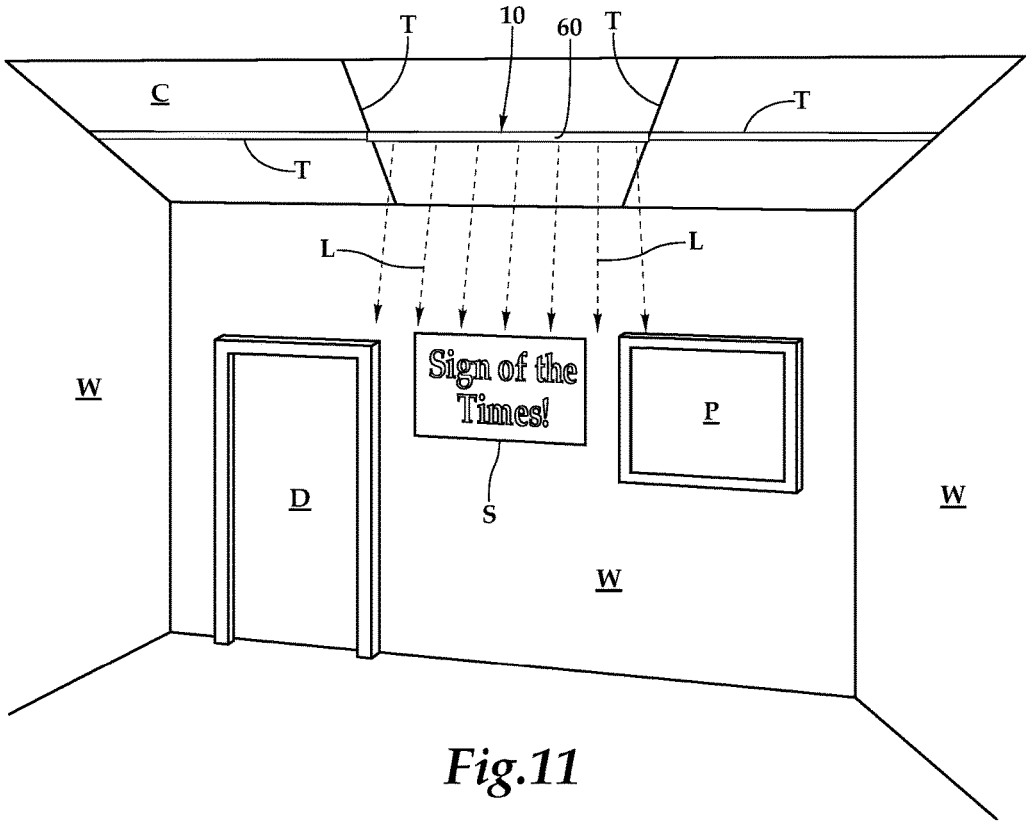
FIG. 11 is a perspective view of an interior space beneath a ceiling with the embodiment of FIG. 1 shown mounted in the ceiling and shining light against a wall of the interior space.

The heat sink 40 is optionally but preferably provided at the upper end 24 of the spine 20. This heat sink 40 has a series of alternating fins 42 with gaps 44 therebetween. The fins 42 and gaps 44 provide surface area through which conduction and convection heat transfer can most effectively happen, at a space entirely above the ceiling tiles C of the ceiling (FIG. 10). In this way, much of heat generated by the lighting source 90 is efficiently directed above the ceiling tiles C. The heat sink 40 could have a greater or lessor number of fins 42 and the fins 42 could be a varying lengths and angles, with the heat sink 40 shown providing one example.

With particular reference to FIGS. 1, 2, 5 and 10, particular details of the front wall 50 and rear wall 60 are described, which define a housing for the lighting source 90, according to the exemplary embodiment of the angled lighting T-bar 10 of this invention. The front wall 50 is a planar structure which extends down from the front end 36 of the rest shelf 30, preferably in a vertical plane perpendicular to the plane in which the rest shelf 30 is formed. This front wall 50 extends down from an upper edge 52 adjacent to the rest shelf 32 a lower edge 54 opposite the upper edge 52. A height of the front wall 50 is generally defined as the distance between the upper edge 52 and lower edge 54. The lower edge 54 defines a forward side of the opening into the recess 70 from which light L from the lighting source 90 emanates, in this embodiment. This front wall 50 could conceivably be shrunk down to the point where it would essentially have no height, and with the lower edge 54 of the front wall 50 located adjacent to the front end 36 of the rest shelf 30. However, most preferably this front wall 50 does have a discernible height between the upper edge 52 and lower edge 54.

The lower edge 54 preferably supports a slot 56 which supports the front edge 82 of a diffuser 80 spanning the opening into the recess 70. This slot 56 is thus spaced below the rest shelf 30 by a distance similar to a height of the front wall 50, which could be a height as little as zero. In the embodiment shown, the front wall 50 has a height which is approximately one-third as large as a width of the rest shelf 30 between the front end 36 and rear end 38. The front wall 50 is a planar structure preferably formed along with the spine 20, rest shelf 30, heat sink 40 and rear wall 60, as a common extrusion. However, the front wall 50 could be separately formed and attached to adjacent elements. Preferably, the front wall 50 has a flat outer surface, but it could be formed to have a geometry and appearance other than flat, especially if the front wall 50 is not formed by extrusion.

The rear wall 60 is a planar structure which is preferably parallel with the front wall 50 and extending vertically downward from the rear end 38 of the rest shelf 30 (when the rest shelf 30 is horizontal), and in an orientation perpendicular to the rest shelf 30. This rear wall 60 is similar to the front wall 50, except that it is larger with a greater height between a top edge 62 adjacent to the rear end 38 of the rest shelf 30 and a bottom edge 64 opposite the top edge 62. A groove 66 is formed in the bottom edge 64, or near the bottom edge 64, which groove 66 faces the slot 56 in the front wall 50 so that in the diffuser 80 can have a rear edge 84 within the groove 66 when the front edge 82 of the diffuser 80 is within the slot 56 of the front wall 50.

In the embodiment depicted, the diffuser 80 has an angle of about 40° away from horizontal. The groove 66 and slot 56 preferably are oriented to hold the diffuser 80 at a desired angle for the diffuser 80.

In the embodiment depicted, a tail 68 extends down on the rear wall 60 below the groove 66 somewhat. This tail 68 can help to keep the light L of the lighting source 90 from shining backward, but rather keeping all (or most) of the light L shining laterally and at least partially away from the rear wall 60. This tail 68 will have a tendency to keep light L from shining directly into eyes of people within the interior space, unless perhaps they are standing directly adjacent to the wall W upon which the light L from the T-bar 10 is shining, and if they look up and directly at the T-bar 10. This can allow the light L to be rather high intensity without "blinding" people within the interior space, and providing a strikingly large amount of light shining upon an object up on the wall W against which the light L is shining from the lighting source 90 within the T-bar 10.

The tail preferably accounts for approximately 20% of an overall height of the rear wall 60. The rear wall 60 preferably has an overall height which is greater than that of a width of the rest shelf 30 between the front end 36 and rear end 38 thereof, and greater than the height of the front wall 50, typically being greater than 50% of a height of the front wall 50, and most preferably between three and four times taller than the front wall 50. Thickness of the front wall 50 and rear wall 60 are preferably similar to each other, and similar to a thickness of the spine 20.

The recess 70 is a space between the front wall 50 and rear wall 60, and below the lower surface 35 of the rest shelf 30. This recess 70 is somewhat triangular in form and allows for the lighting source 90 to reside therein, and preferably maintained at an angle so that a centerline CL of lighting L emanating from the lighting source 90 passes perpendicular to the diffuser 80 and out of the recess 70, in a lateral fashion which is neither vertical nor horizontal when the T-bar 10 is oriented to support a ceiling horizontally.

The diffuser 80 spans this opening into the recess 70 between the slot 56 in the front wall 50 and the groove 66 in the rear wall 60. In alternative embodiments, the diffuser 80 could have a front edge 82 and rear edge 84 thereof supported in manners other than fitting within the slot 56 and groove 66. For instance, the edges 82, 84 of the diffuser 80 could be bonded to portions of the walls 50, 60 or retained by fasteners to portions of the walls 50, 60, or to portions of the rear wall 60 and the front end 36 or other portions of the rest shelf 30. By providing the diffuser 80 as a planar structure of rectangular form having a width between the front edge 82 and rear edge 84 similar to a distance between the slot 56 and groove 66, the diffuser 80 can merely slide from an end of the T-bar 10 into the slot 56 and groove 66 for convenient placement of the diffuser 80 therein.

The diffuser 80 could in one embodiment merely be a transparent protective layer to protect the lighting source 90, or could be dispensed with all together. Most preferably, the diffuser 80 provides for at least some diffusion of light L passing therethrough, so that light L is caused to appear to emanate from the surface of the diffuser 80, rather than from the lighting source 90 or particular portions of the lighting source 90, within the recess 70 and behind the diffuser 80.

The ends of the T-bar 10 optionally but preferably include some form of end cap to close off the recess 78 end thereof, which can have a contour similar to that existing at the ends of the housing defined by the front wall 50, rear wall 60 and rest shelf 30, to close this area. Another form of end cap can merely be an alignment bracket which can allow two T-bars 10 to be provided end to end and aligned with each other to provide continuous lighting along a line having a greater length than each T-bar 10 by itself, and with such a bracket helping to keep the housings of the two T-bars 10 precisely aligned together. In such an end-to-end configuration, another option would be to have no bracket or end cap between the two T-bars 10.

Figure 8:
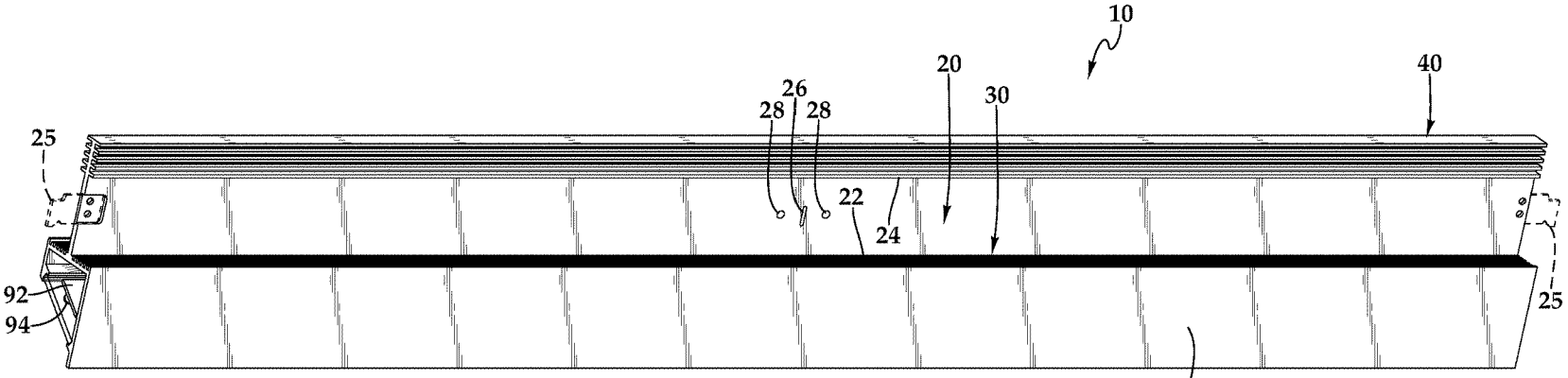
FIG. 8 is a perspective view from the rear and above, further depicting the embodiment of FIG. 1, and without a central portion cut away, and with the light diffuser and light source included within a recess of a housing thereof.
Figure 9:
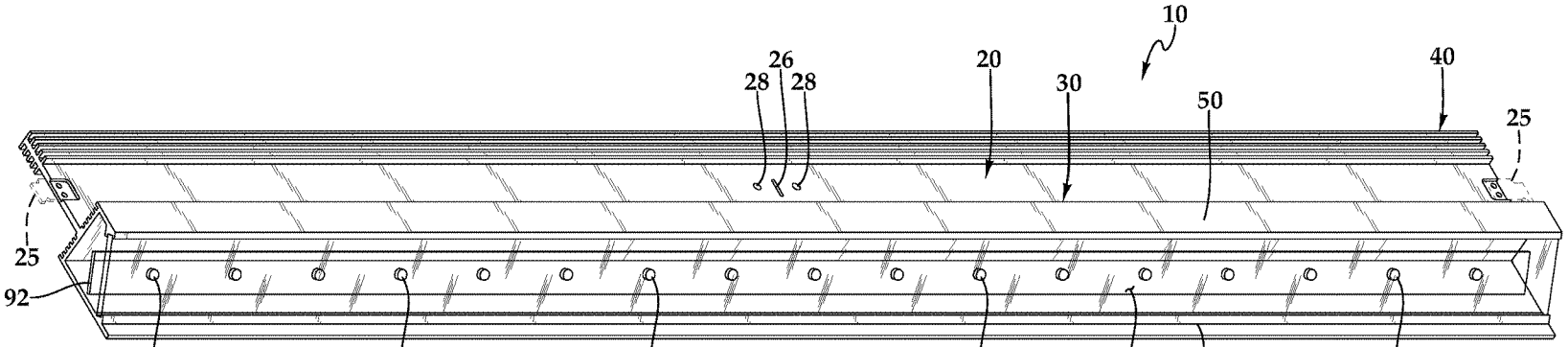
FIG. 9 is a perspective view from the front and below, further depicting that which is shown in FIG. 8.

With particular reference to FIGS. 8-10, details of the lighting source 90 are described, according to this exemplary embodiment. The lighting source 90 shown herein includes LEDs 94 mounted in periodic spacing along a printed circuit board (PCB) 92. The PCB 92 supports the LEDs 94 thereon, as well as other electronics 96. Wiring 98 supplies electric power to the PCB 92 and associated LED 94 and electronics 96, to appropriately power the lighting source 90, and to cause light L to shine for the LEDs 94. The wiring 98 is routed out of the recess 70 in the housing, such as up through the wiring holes 37 (FIG. 1) and then can pass up to some form of power supply. In the case of LED 94 lighting for the lighting source 90, this power supply is typically a DC power supply, which could be incorporated into the electronics 96 on the PCB 92, but preferably is a separate power supply which can be mounted above the ceiling, or in one embodiment mounted to upper portions of the spine 20, such as is disclosed in U.S. Pat. No. 8,177,385, incorporated herein by reference in its entirety.

The LEDs 94 or other sources of light (such as incandescent lightbulbs) are preferably mounted on the PCB 92 so that they shine light with a centerline CL perpendicular to the PCB 92 and perpendicular to the diffuser 80. To achieve this orientation, the PCB 92 is oriented diagonally within the recess 70, and within a plane parallel with the diffuser 80. Some form of bracket can be provided within the recess 70 to allow for mounting of the PCB 92 at this desired angle. Preferably, the LEDs 94 are directly behind a center point in the diffuser 80. The centerline CL extends perpendicularly through the diffuser 80, and preferably has an angle $\alpha$ away from horizontal (FIG. 10) which measures approximately 50° in this exemplary embodiment. This angle $\alpha$ could be as little as 10° and still provide lateral light L shining away from the T-bar 10, or could measure as much as up to slightly less than 90°, in instances where it is just barely providing some degree of lateral light shining, rather than light shining straight down from the T-bar 10.

In one embodiment, the diffuser 80 and PCB 92 are fixed together, so that a parallel arrangement between the PCB 92 and LEDs 94, relative to the diffuser 80 are maintained. As another alternative, one end of the diffuser 80, such as the front edge 82 could, instead of being fixed within a slot 56, be held in an adjustable fashion, so that some degree of adjustability is provided for the direction in which the light L shines from the lighting source 90. As one example, a series of slots 56 (and/or grooves 66) could be provided, such as with each slot 56 (and/or groove 66) spaced 10° from adjacent slots 56 (and/or grooves 66), so that a user could select an angle $\alpha$ for lighting L to emanate from the T-bar 10. As another alternative, some form of spacer could be utilized which engages with the front wall 50 and/or rest shelf 30 to hold the front edge 82 of the diffuser 80, and associated lighting source 90 at a desired angle different than the basic angle $\alpha$ depicted herein. As a further alternative, separate diffusers 80 (and associated optics or with the lighting source 90 mounted (or mountable) thereto, could be provided which have an orientation resulting for the centerline CL of the light L shining therefrom, which is non-perpendicular to a plane between the slot 56 and groove 66. A set of diffusers 80 with different angles for the centerline CL of the light L can be provided and a user can select the desired diffuser 80 to select the desired light L angle for the centerline CL from the set of diffusers 80. The selected diffuser 80 is then attached to the housing, such as through the slot 56 and groove 66 and the lighting source 90 attached thereto if needed.

As another alternative, the lighting source 90 could be oriented generally downwardly, such as with the PCB 92 in a horizontal plane adjacent to the lower surface 35 of the rest shelf, and rely on the diffuser 80 and geometry of the front wall 50 and/or rear wall 60 to direct the light L laterally as it emanates from the housing. Other options for redirecting light L laterally include mirror(s) and/or fiber-optics, lenses or prisms. While the diffuser 80 is shown relatively thin and inboard of the walls 50, 60 it could be thicker than the slot 56 and groove 66 and could extend past the walls 50, 60 and optionally wrap around the walls 50, 60 somewhat.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A lighting and ceiling support T-bar, comprising in combination:

a rest shelf having a front portion extending from a junction to a front end and a rear portion extending from said junction to a rear end opposite said front end;

said front portion and said rear portion of said rest shelf oriented in a common rest shelf plane;

a spine extending from said junction in a direction spaced from said rest shelf plane;

a housing coupled to said rest shelf and on a side of said rest shelf opposite said spine;

said housing including an interior recess with an opening accessing said recess, at least for light to exit said recess;

said opening facing at least partially downwardly when said rest shelf plane is oriented horizontally;

said housing supporting at least one light source therein; and a centerline of light emitted from the T-bar and originating at said light source, extending at least partially laterally after exiting said opening, when said rest shelf is oriented horizontally.

2. The T-bar of claim 1 wherein said light source includes an LED.

3. The T-bar of claim 2 wherein said light source includes a printed circuit board with electronics on said printed circuit board interposed between an electric power source and said at least one LED, such that electric power to said printed circuit board causes light to be emitted from said LED.

4. The T-bar of claim 1 wherein said opening includes a diffuser covering at least a portion of said opening, said light source within said recess and entirely behind said diffuser, said diffuser allowing at least a portion of light from said light source to be transmitted therethrough.

5. The T-bar of claim 4 wherein said opening includes a slot at a front thereof and a groove at a rear thereof, said slot facing said groove, said diffuser having a planar form and having a front edge opposite a rear edge, said slot spaced from said groove by a size of said diffuser between said front edge and said rear edge, and with said front edge located within said slot and said rear edge located within said groove.

6. The T-bar of claim 1 wherein said housing includes a rear wall extending from said rear end of said rest shelf on a side of said rest shelf opposite said spine, said rear wall having a top edge opposite a bottom edge, said top edge adjacent to said rest shelf, and with a rear of said opening located closer to said bottom edge of said rear wall than to said top edge of said rear wall.

7. The T-bar of claim 6 wherein a front wall extends from said front end of said rest shelf on a side of said rest shelf opposite said spine, said front wall parallel with said rear wall, said rear wall larger than said front wall, said front wall having an upper edge opposite a lower edge, said upper edge adjacent to said rest shelf, and with a front of said opening located closer to said lower edge of said front wall than to said upper edge of said front wall.

8. The T-bar of claim 1 wherein an angle of said centerline of the light from said light source away from said common rest shelf plane is less than 90° as the light shines from the T-bar.

9. The T-bar of claim 8 wherein said angle of said centerline away from said common rest shelf plane is more than 10°, as the light shines from the T-bar.

10. The T-bar of claim 1 wherein said rest shelf has an upper surface opposite a lower surface, said upper surface closer to said spine than said lower surface.

11. The T-bar of claim 10 wherein a heat transfer fin extends at least partially upward from said upper surface of said rest shelf, and wherein said heat transfer fin extends at least partially laterally from an upper end of said spine opposite said junction.

12. A lighting and ceiling support, comprising a combination:

a rest shelf having a front portion extending to a front end, and having a rear portion extending to a rear end opposite said front end;

a spine coupled to said rest shelf and extending upward from said rest shelf;

a housing coupled to said rest shelf and at least partially beneath said rest shelf;

said housing including an interior recess with an opening accessing said recess, at least for light to exit said recess;

said housing including at least one light source therein; and a centerline of light emitted from the support and originating at said light source, extending at least partially laterally after exiting said opening, when at least a portion of said rest shelf is oriented with at least one said portion thereof extending horizontally.

13. The support of claim 12 wherein said light source includes an LED.

14. The support of claim 13 wherein said light source includes a printed circuit board with electronics on said printed circuit board interposed between an electric power source and said at least one LED, such that electric power to said printed circuit board causes light to be emitted from said LED.

15. The support of claim 12 wherein said opening includes a diffuser covering at least a portion of said opening, said light source within said recess and entirely behind said diffuser, said diffuser allowing at least a portion of light from said light source to be transmitted therethrough.

16. The support of claim 15 wherein said opening includes a slot at a front thereof and a groove at a rear thereof, said slot facing said groove, said diffuser having a planar form and having a front edge opposite a rear edge, said slot spaced from said groove by a size of said diffuser between said front edge and said rear edge, and with said front edge located within said slot and said rear edge located within said groove.

17. The support of claim 12 wherein said housing includes a rear wall extending from said rear end of said rest shelf on a side of said rest shelf opposite said spine, said rear wall having a top edge opposite a bottom edge, said top edge adjacent to said rest shelf, and with a rear of said opening located closer to said bottom edge of said rear wall than to said top edge of said rear wall.

18. The support of claim 17 wherein a front wall extends from said front end of said rest shelf on a side of said rest shelf opposite said spine, said front wall parallel with said rear wall, said rear wall larger than said front wall, said front wall having an upper edge opposite a lower edge, said upper edge adjacent to said rest shelf, and with a front of said opening located closer to said lower edge of said front wall than to said upper edge of said front wall.

19. The support of claim 18 wherein a tail extends down past said rear of said opening, said tail at least partially blocking light from said light source from shining at an area or a side of said rear wall opposite said light source.

20. The support of claim 12 wherein an angle of said centerline of the light from said light source away from horizontal is less than 90° as the light shines from the support.

21. The support of claim 12 wherein an angle of said centerline of the light from said light source is adjustable.

22. A method for shining light from a ceiling in a lateral direction, while also holding up portions of a ceiling, including the steps of:

orienting a ceiling support within a ceiling and adjacent to a wall, the support having a rest shelf having a front portion extending to a front end, and having a rear portion extending to a rear end opposite the front end, a spine coupled to the rest shelf and extending upward from the rest shelf, a housing coupled to the rest shelf and at least partially beneath the rest shelf, the housing including an interior recess with an opening accessing the recess, at least for light to exit the recess, the housing including at least one light source therein, and a centerline of light emitted from the support and originating at the light source extending at least partially laterally after exiting the opening when at least a portion of the rest shelf is oriented horizontally;

resting at least one ceiling structure upon at least one of the front portion and/or the rear portion of the rest shelf; and powering the light source with electric power to cause the light source to emit light at least partially laterally out of said opening of said housing.

23. The method of claim 22 wherein said support of said orienting step is located adjacent to a wall which is desired to be lit, and with the centerline of the light source pointing at least partially at the wall, such that light from the light source shines on the wall during said powering step.

24. The method of claim 22 including the further step of adjusting the centerline of the light exiting the support to a desired angle.

25. The method of claim 24 wherein said adjusting step includes adjusting an angle of the light source.

26. The method of claim 24 wherein said adjusting step includes adjusting an angle of optical elements in front of the light source.

27. The method of claim 24 wherein said adjusting step includes selecting at least one optical element which angles the light to the desired angle and placing the at least one optical element of said selecting step in front of the light source.

* * * * *